US005743196A

United States Patent [19]

Beryozkin et al.

[11] Patent Number: 5,743,196

[45] Date of Patent: Apr. 28, 1998

[54] MOBILE WASTE INCINERATOR

[76] Inventors: Vladimir Beryozkin, 3 Stephen Ct., New City, N.Y. 10956; Alexander Rudshteyn, 2060 Ocean Ave., #6A, Brooklyn, N.Y. 11230

[21] Appl. No.: 706,905

[22] Filed: Sep. 3, 1996

[51] Int. Cl.[6] ..... F23G 5/40

[52] U.S. Cl. ..... 110/240; 110/222; 110/224; 110/259; 110/257; 404/108

[58] Field of Search ..... 110/240, 241, 110/219, 222, 224, 234, 246, 258, 257, 259; 404/90, 108, 75

[56] References Cited

U.S. PATENT DOCUMENTS

| | | | |
|---|---|---|---|
| 2,127,328 | 8/1938 | Egan | 110/240 |
| 2,985,120 | 5/1961 | Brandt et al. | 110/240 |
| 3,371,629 | 3/1968 | Engdahl et al. | 110/240 X |
| 3,785,302 | 1/1974 | Davis | 110/240 X |
| 3,939,783 | 2/1976 | Du Chambon | 110/240 |
| 5,131,788 | 7/1992 | Hulicsko | 404/108 |
| 5,237,938 | 8/1993 | Fujimori et al. | 110/240 |

FOREIGN PATENT DOCUMENTS

| | | | |
|---|---|---|---|
| 59-27116 | 2/1984 | Japan | 110/240 |

*Primary Examiner*—Henry A. Bennett
*Assistant Examiner*—Susanne C. Tinker
*Attorney, Agent, or Firm*—Ilya Zborovsky

[57] ABSTRACT

A mobile waste incinerator has a moving vehicle having an engine with an exhaust gas system, a receiving chamber arranged to receive waste to be incinerated and to preliminarily heat the waste, the receiving chamber being connected with the exhaust system so as to receive the exhaust gases for preliminary heating of the waste, a preparation chamber connected with the receiving chamber for receiving the waste heated in the receiving chamber and provided with means for reducing a size of the wastes, the preparation chamber also having means for injecting fuel, an incineration chamber connected with the preparation chamber and provided with means for mixing the fuel with air and igniting a mixture, the incineration chamber being connected with the preparation chamber so that hot gases from the incineration chamber are supplied into the preparation chamber, means for connecting the chambers with one another and closing chambers from one another, and means for discharging the wastes from the incineration chamber.

13 Claims, 2 Drawing Sheets

MOBILE WASTE INCINERATOR

BACKGROUND OF THE INVENTION

The present invention relates to devices for disposal and elimination of different kinds of wastes, in particular solid, human, hospital (infectious) wastes on site of civilian and military hospitals, parks, stadiums, apartment complexes and the like, as well as in disaster areas, construction sites, military bases, ports, etc. Disposal of solid, human and hospital hazardous wastes is an immense problem of modern times. Drastically and consistently increasing volumes of these wastes and various activities associated with generation, on site storage, collection, transfer and transportation, processing, recovery and disposal of the residential, industrial, medical and agricultural wastes dictate strictly enforced laws and regulations prohibit burial of residential, industrial and hazardous wastes without proper incineration.

Devices of the above mentioned general type are known in the art. One of such devices is disclosed for example in U.S. Pat. No. 4,875,420 and used for a mobile waste treatment, while another device is disclosed in U.S. Pat. No. 4,852,815 which discloses a transit refuse recovery and incineration system. U.S. Pat. No. 4,730,564 deals with multistage rotary kiln with burning waste, U.S. Pat. No. 4,688,494 deals with self-container incinerator on wheels and is designed to be towed by a truck from location to location to handle the residential garbage disposal, U.S. Pat. Nos. 4,627,365, 3,938,450 and 3,906,874 disclose devices for collecting and disposing refuse on the wheel chassis.

The above mentioned devices are mostly used for domestic refuse recovery and incineration. Most of them are very sophisticated systems which require up to 2 months for its installation once they delivered on site. Such assembly and disassembly requires at lest 23 hours for the device disclosed for example in U.S. Pat. No. 4,875,420. The Devices have multiple preparation and combustion chambers and require several huge double trailers to be mounted on. Also a power van for carrying transformers is needed, a control van for instrumentation, control and switches is needed as well, parallel with several other support vehicles and support structures. These types of systems require many operators, drivers and a power line. They are very expensive in design, development and operation.

Some of these systems are specifically designed only for residential refuse collection by moving from house to house such as devices disclosed in U.S. Pat. Nos. 4,852,815 and 3,682,117, and are provided with adjustable stationary furnace chamber. Most of them have a relatively low combustion temperature, in particular 900°–1,000° C., require separate power unit for waste processing and incinerator operation, and very good roads for transportation. They are not designed for incineration and elimination of solid, hazardous waste or hospital infectious wastes. These mobile incinerators are not capable to work in real military field conditions and in autonomous mode without using outside power supply. They also have a long residence time and low productivity and are not adaptable to incineration in the field when it is necessary to incinerate regular and hazardous wastes simultaneously. They have a long residence time and low productivity and are not adaptable to incineration in the field when it is necessary to incinerate regular and hazardous wastes simultaneously. They have substantial heat generation and are not capable of satisfying current requirements for emission control. While incineration of solid, human and hospital wastes on site or between the sites is the most economically feasible method, it is not being widely used because of lack of economically feasible and safe modern technology and equipment.

SUMMARY OF THE INVENTION

Accordingly, it is an object of the present invention to provide a mobile device for incineration of solid, human, hospital and other regular and hazardous wastes on site and between sites, which avoids the disadvantages of the prior art.

More particularly, it is an object of the present invention to provide the device of the above mentioned type which is mobile, highly efficient and maneuverable, compact, has an autonomous power, is capable of operating in extreme field military conditions with minimum heat and capable of operating on standard fuel such as Diesel fuel, kerosine or jet fuel, capable of being switched without loss of operational time to other types of fuels such as liquid propane, fuel sell, etc. adaptable to different modes of transportation such as automotive, barge, ship, railroad car, etc., and also is completely autonomous and does not require an outside additional electric power source.

In keeping with these objects and with others which will become apparent hereinafter, one feature of the present invention resides, briefly stated, in a mobile waste incinerator which has a moving vehicle having an engine with an exhaust gas system, a receiving chamber arranged to receive waste to be incinerated and to preliminarily heat the waste, the receiving chamber being connected with the exhaust system so as to receive the exhaust gases for preliminary heating of the waste, a preparation chamber connected with the receiving chamber and provided with means for reducing a size of the wastes, the preparation chamber also having means for injecting fuel, an incineration chamber connected with the preparation chamber and provided with means for mixing the fuel with air and igniting a mixture, the incineration chamber being connected with the preparation chamber so that hot gases from the incineration chamber are supplied into the preparation chamber, means for connecting the chambers with one another and closing chambers from one another, and means for discharging the wastes from the incineration chamber.

When the mobile waste incinerator is designed in accordance with the present invention it eliminates the disadvantages of the prior art and provides for the above mentioned highly advantageous results.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
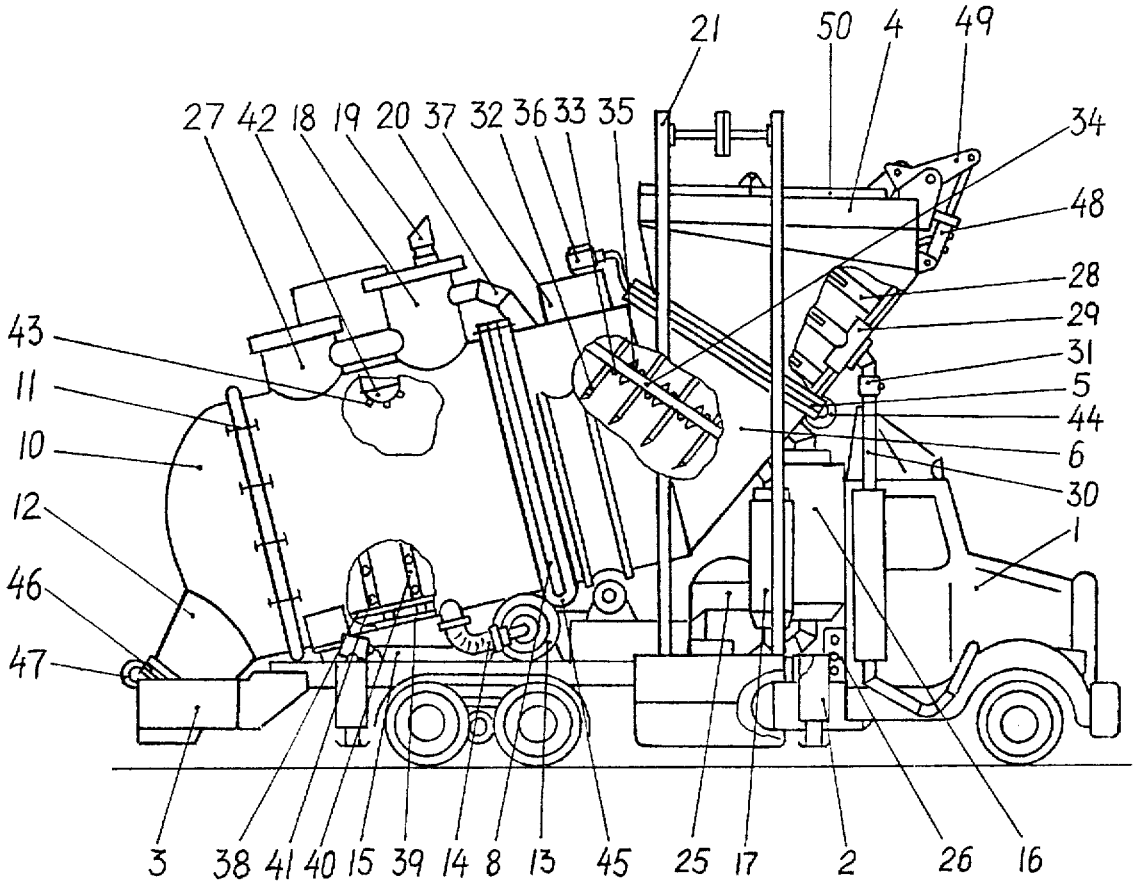
FIG. 1 is a side view of a mobile waste incinerator in accordance with the present invention.
Figure 2:
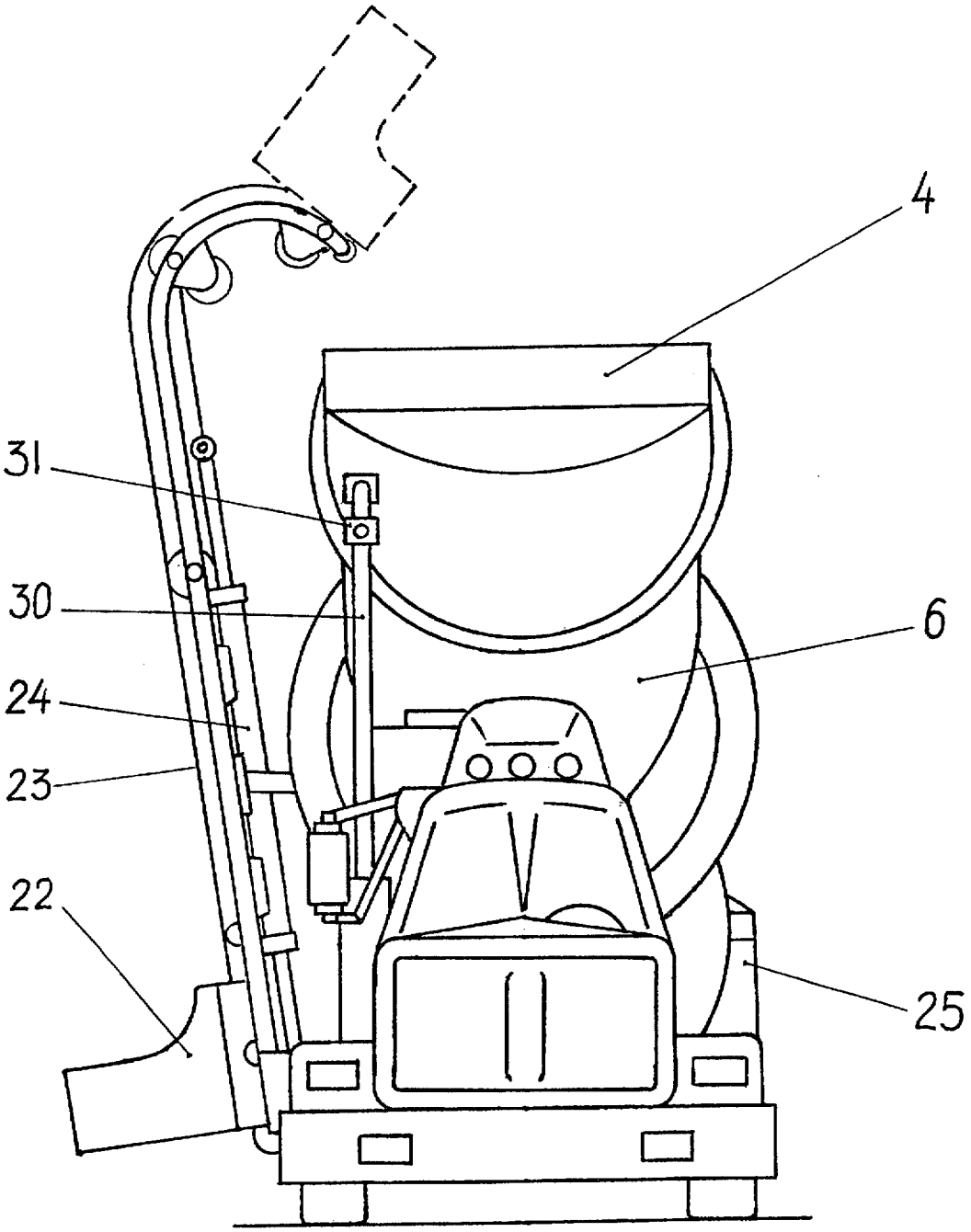
FIG. 2 is a front view of the mobile waste incinerator of the present invention.

A mobile waste incinerator in accordance with the present invention has a mounting platform 1 based on an automobile truck, barge, etc. The platform 1 has two support jacks 2 for partial unloading of the truck during processing of waste in stationary condition.

Loading elevators 22 are provided for delivery of the waste in a receiving chamber 4 which has a system of preliminary heating of the waste. The system of preliminary heating includes exhaust gas delivery pipes 28 located in walls of the chamber 4 and connected with an air distributor valve 29. The valve 29 is connected with an exhaust pipe 30 of the truck. In order to control the air pressure in the waste chamber 4 the heating system is provided with exhaust gas pressure regulating valve 31. The exhaust gases from the truck engine are supplied into the distributor valve 29 and through the pipes 28 deliver to the exhaust windows and into the chamber 4 to heat the waste.

The incinerator further has a preparation chamber 6 with large rotating cutting blades 32 and small blades 35 for preliminary waste size reduction. The already preheated and diminished in size waste in the chamber 6 is injected with fuel through injectors 33, mounted on a rotating shaft 34 on which the cutting blades 32 and 35 are mounted as well. The shaft 34 is rotated by hydraulic motor 36 and a gear box 37.

The chambers 4 and 6 are separated form each other by a first shutter 5. When the shutter is open the chambers are connected with one another and when the shutter is closed they are separated from one another. The displacement of the shutter 5 is performed by a hydraulic cylinder-piston unit 44.

The incinerator further has a largest chamber 9 provided for incineration of waste. The chamber 4 and 6 are inclined up to 45° relative to a horizontal plane and the chamber 6 can rotate up to 45°, and also the chamber 9 can incline up to 25° and rotate up to 45° for better waste mixing, fuel saturation and burning of waste, and its unloading during and after the preparation and incineration cycles.

The rotation of the chamber 9 is performed by a rotation mechanism 7 which includes a hydraulic motor and a worm gear.

A second shutter 8 separates the chambers 6 and 9 from one another. A hydraulic cylinder-piston unit 45 moves the shutter 8 so as to separate the chambers and to communicate them again with each other. The shutter 8 is formed as a double-walled element with a water circulation for its cooling. A cooling system of the shutter is connected through a rubber hose to a cooling system of the chamber 9.

The incineration chamber 9 has a spherical protruding accumulator 10 which can be removed for cleaning and maintenance of the chamber 9. The accumulator 10 is connected with the chamber 9 by joint bolts 11.

The machine also has a discharge device located in a tube 12 and provided with a discharge shutter 46 for discharging the residue of the incinerated waste. The shutter 46 is moved between its closed and open positions by a hydraulic cylinder-piston unit 47. It also has an exhaust gas discharge system with a decontamination cyclone 16 and a double chamber filter 18 for preliminary cleaning of the exhaust gases, a safety valve 19 and a connecting pipe 20. In order to contain the heat inside the chamber 9 and drastically reduce heat emission, the chamber 9 has a water cooling system for walls 38 and 39 which is provided with a water pump 13, a connection hose 14, and a radiator 15.

A system for self-loading of the waste is provided. It has supports 21, a loading elevator 22, an elevator cable 23 and a pneumatic cylinder-piston unit 24, a system 25 for fresh air delivery into the chamber 9, and an operator control and operation panel 26 with elements for controlling an operation of the incinerator. Two rechargeable 24 volt batteries are provided.

A cover 50 opens and closes the chamber 4. A hydraulic cylinder-piston unit 48 connected with the bracket 49 moves the cover 50 between its open and closed positions.

The mobile waste incinerator operates in the following manner:

The incinerator is installed on a flat surface and the platform 1 is placed with support jacks 2 in working position. Then the truck engine and the systems and mechanisms of the incinerator are switched on.

The waste is dumped into the loading elevator 22 and delivered to the receiving chamber 4. In the chamber 4 the waste is preheated with the exhaust gases from the truck engine and delivered gravitationally in the shutter 5 and the chamber 6 accordingly for aeration, ionization, size reduction and heating up to 300° F. by hot gases coming from the incineration chamber 9. In the chamber 6 diminishing of the waste, injection, saturation and heating of the waste with fuel, and thorough rotation and mixing of the waste simultaneously with the ionization are provided. After completion of the process of the waste preparation and opening of the second shutter 8, the waste is transported gravitationally and under incoming fresh air pressure into the incineration chamber 9. Heating of the waste in the chamber 6 is performed by the heat which comes from the incinerator chamber 9 when the secondary shutter 8 is open. In this case the hot air from the chamber 9 is supplied partially into the chamber 6 and heats the waste.

The aeration system is located in three rings 40 on the internal walls 38 of the chamber 9 and connected with the fresh air delivery system 25. The fresh air is supplied through injectors 41 into the chamber 9 for aeration and better burning of the waste. The tilting and turning of the incineration chambers 6 and 9 improve mixing of the waste.

The sealed and efficient double-walled incineration chamber 9 provides complete incineration due to the high temperature inside the chamber, which is approximately 2,700° F. The process of incineration is very short.

The internal wall 38 of the chamber 9 is composed of titanium and insulated with a heat resistant material to improve efficiency and heat containment. The external wall the chamber 9 is composed of stainless steel or another appropriate material. The cooling housing with circulating water is located between the chamber walls. It also has heat radiator 15.

The fuel delivery, dispersion and inflammation system includes the high pressure pipes, two filters and the distributor 42 with the fuel injectors 43. It also has a fuel tank located between the truck bumper and truck radiator. The fuel is ignited with twelve spark plugs located on the internal wall of the incineration chamber 9 and in close proximity to the injectors 43. The fuel injection and ignition as well as air mixing is performed automatically by a distributor 42 and three thermostats which control the temperature inside the incineration chamber 9. One thermostat is provided for four plugs. The fuel injection is performed first and after one–two seconds the fuel ignition is performed. The economically feasible ratio of a fuel and air in the chamber is being controlled by the accelerator.

The exhaust gases of the waste combustion are picked up by the stream of air directed through the chamber 9 and delivered to the after-burner extending through the chamber 9 for complete burning of volatilities and returning gases to the cyclone 16 and to the turbine unit 25 for mixing the same with the fresh air supplied downwardly through the air ducts located on the outer surface of the chamber 6 and ending in the walls of the chamber 9. At the end of the waste incineration process the gases are supplied to the exhaust gas neutralizer which includes water, metal and material filters located in the decontamination cyclone 17 and capable of complete neutralization and nullification of odoriferous and other gases. Before releasing the gases into the atmosphere, they are also directed to the double chamber filter 18. For an emergency release of air pressure a safety valve 19 is provided. The above described closed loop complete air burning system allows neutralization of gases, nullification of their odor and enrichment of the gases with the fresh air. It is highly effective, environmentally safe, and has a low heat emission. If required, the roasted ash as a residue of incineration is conveyed into a discharge mechanism of the tube 12 and deposited into a removable container or discharge bin 3.

It will be understood that each of the elements described above, or two or more together, may also find a useful application in other types of constructions differing from the types described above.

While the invention has been illustrated and described as embodied in a mobile waste incinerator, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed as new and desired to be protected by Letters Patent is set forth in the appended claims:

1. A mobile waste incinerator, comprising a moving vehicle having an engine with an exhaust gas system; a receiving chamber arranged to receive waste to be incinerated and to preliminarily heat the waste, said receiving chamber being connected with said exhaust system so as to receive the exhaust gases for preliminary heating of the waste; a preparation chamber connected with said receiving chamber for receiving the waste heated in said receiving chamber and provided with means for reducing a size of the wastes, said preparation chamber also having means for injecting fuel; an incineration chamber connected with said preparation chamber and provided with means for mixing the fuel with air and igniting a mixture, said incineration chamber being connected with said preparation chamber so that hot gases form said incineration chamber are supplied into said preparation chamber; means for connecting said chambers with one another and closing chambers from one another; and means for discharging the wastes from said incineration chamber.

2. A mobile waste incinerator as defined in claim 1, wherein said means for separating said chamber from on another include at least one shutter located between each two of said chambers and movable between an open position and a closed position.

3. A mobile waste incinerator as defined in claim 1, wherein at least one of said shutters being provided with means for cooling said at least one shutter.

4. A mobile waste incinerator as defined in claim 1, wherein said chambers are located one after the other and arranged so that the wastes move successively from said receiving chamber to said preparation chamber and said incineration chamber under the action of gravity.

5. A mobile waste incinerator as defined in claim 1, wherein said receiving chamber is stationary while said preparation chamber and said incineration chamber are rotatable; and further comprising means for rotating said preparation chamber and said incineration chamber.

6. A mobile waste incinerator as defined in claim 1, wherein said preparation chamber and said incineration chamber are inclined at an angle relative to a horizontal plane.

7. A mobile waste incinerator as defined in claim 1; and further comprising an aeration system associated with said incineration chamber and including ejector supplying fresh air into said incineration chamber.

8. A mobile waste incinerator as defined in claim 1; and further comprising means for igniting the fuel-air mixture in said incineration chamber; and means controlling temperature in said incineration chamber and cooperation with said igniting means.

9. A mobile waste incinerator as defined in claim 1; and further comprising means for receiving exhaust gases from said incineration chamber; after burning the exhaust gases and neutralizing of the exhaust gases.

10. A mobile waste incinerator as defined in claim 1, wherein said means for supplying the exhaust gases into said receiving chamber include a plurality of pipes and a distributing valve.

11. A mobile waste incinerator as defined in claim 1, wherein said means for diminishing the size of wastes in said preparation chamber include a rotatable shaft and a plurality of blades arranged in said shaft and rotating with the latter, said means for injecting fuel in said preparation chamber including a plurality of ejectors mounted on said rotating shaft.

12. A mobile waste incinerator as defined in claim 1; further comprising an accumulator connected with said incinerating chamber and accumulating the incinerated waste, said incinerator being removable from said incineration chamber.

13. A mobile waste incinerator as defined in claim 1, wherein said incineration chamber is provided with two heat contained liquid cooled walls composed of heat resistant material; and further comprising means for controlling temperature inside said chamber; means for controlling combustible mixture inside said chamber; means for efficient burning of volatilities inside said chamber; and means for lowering heat emission from said chamber.

* * * * *